US008857424B2

(12) United States Patent
Lambertson

(10) Patent No.: US 8,857,424 B2
(45) Date of Patent: Oct. 14, 2014

(54) EXHAUST HOOD WITH ADJUSTABLE SUPPLY AIR CONTAINMENT AIR STREAMS AND AIR CURTAINS

(75) Inventor: Jeffrey S. Lambertson, Danville, CA (US)

(73) Assignee: Streivor, Inc., Hayward, CA (US)

( * ) Notice: Subject to any disclaimer, the term of this patent is extended or adjusted under 35 U.S.C. 154(b) by 1104 days.

(21) Appl. No.: 12/574,623

(22) Filed: Oct. 6, 2009

(65) Prior Publication Data

US 2010/0126494 A1 May 27, 2010

Related U.S. Application Data

(60) Provisional application No. 61/103,536, filed on Oct. 7, 2008.

(51) Int. Cl.
*F24C 15/20* (2006.01)
*B08B 15/02* (2006.01)
*F24F 9/00* (2006.01)

(52) U.S. Cl.
CPC . *F24F 9/00* (2013.01); *F24C 15/20* (2013.01); *F24F 2009/007* (2013.01); *B08B 15/02* (2013.01)
USPC ..... 126/299 D; 126/299 F; 126/299 R; 126/299 E; 454/237; 454/88

(58) Field of Classification Search
USPC ..... 126/299 D, 299 F, 299 R, 299 E, 381.1; 454/237, 88; 55/DIG. 36, 88
See application file for complete search history.

(56) References Cited

U.S. PATENT DOCUMENTS

| | | | | |
|---|---|---|---|---|
| 4,286,572 | A | 9/1981 | Searcy et al. | |
| 4,700,688 | A * | 10/1987 | Searcy et al. | 126/299 D |
| 4,811,724 | A | 3/1989 | Aalto et al. | |
| 5,285,771 | A * | 2/1994 | Griffes | 126/299 D |
| 5,320,088 | A * | 6/1994 | Nester | 126/299 D |
| 6,394,083 | B1 | 5/2002 | Lambertson | |
| 6,851,421 | B2 | 2/2005 | Livchak et al. | |

* cited by examiner

*Primary Examiner* — Avinash Savani

(74) *Attorney, Agent, or Firm* — Kilpatrick Townsend & Stockton LLP

(57) ABSTRACT

An exhaust hood and related methods for exhausting fumes are disclosed. The exhaust hood comprises a housing forming a collection region having an entry portion and an upper portion disposed above the entry portion, an exhaust inlet coupled with the housing and configured to draw air from the entry and upper portions, and a supply assembly coupled with the housing and configured to output a flow of supply air. The supply assembly is configured to direct a first portion of the supply air across the collection region generally towards the exhaust inlet and direct a second portion of the supply air generally downward away from the collection area. The directed first portion of the supply air divides the collection region into the entry and upper portions. The portion of the supply air directed into at least the first portion or the second portion can be adjustable.

20 Claims, 7 Drawing Sheets

SECTION A - A

EXHAUST HOOD WITH ADJUSTABLE SUPPLY AIR CONTAINMENT AIR STREAMS AND AIR CURTAINS

CROSS-REFERENCES TO RELATED APPLICATIONS

This application claims the benefit of U.S. Provisional Patent Application No. 61/103,536, filed Oct. 7, 2008, entitled "Exhaust Hood with Adjustable Supply Air Containment Jets and Air Curtains," the full disclosure of which is hereby incorporated herein by reference.

BACKGROUND

The present invention relates generally to exhaust hoods, and, more particularly, to energy-efficient exhaust hoods for use in commercial kitchens.

Commercial cooking equipment create varying quantities of heat and effluents as a by-product of their cooking processes. For example, a commercial kitchen may have a cook line with burners for cooking pans, deep fryers, griddles, steam tables, and grills. In order to remove waste gas, heat, and/or effluents from the cook line, a commercial kitchen typically includes a kitchen ventilation system. Such a kitchen ventilation system typically includes an exhaust assembly that exhausts air collected in an exhaust hood. In many instances, a source of supply air delivers make-up air into the kitchen.

Many known exhaust hoods are installed above cooking equipment so as to position their collection region to capture effluents generated by the cooking equipment. Such exhaust hoods typically draw exhaust air from the collecting region through a filtering device that separates the collecting region from an exhaust chamber. The exhaust chamber is typically connected to an exhaust duct, which is typically connected to an exhaust fan. Known exhaust hoods may also include an internal or external make-up air chamber facilitating the total or partial delivery of make-up air.

A typical commercial kitchen has a variety of types of cooking equipment (e.g., burners for cooking pans, deep fryers, griddles, steam tables, and grills). Often, the cooking equipment is aligned side-by-side to form one continuous cook line. As a result, the cook line may place varying cooking techniques, temperatures, fuels and loads next to each other. It is also typical for a single exhaust hood to be installed over the cook line made up of varying cooking equipment.

The design and specifications for kitchen ventilation systems, much like other ventilation systems, are guided and governed by various standards (e.g.; architectural; American Society of Heating, Refrigerating, and Air-Conditioning Engineers (ASHRAE); and Underwriters Laboratories (UL)). The challenges of ventilating a cook line with varying cooking equipment, temperatures, fuels and loads have been well documented. A common technique for designing and operating an exhaust hood over a cook line involves "over powering" the hood, whereby the ventilation system and its associated exhaust hood are engineered to be more than capable of meeting the worst case scenario that could possibly arise for the capture and containment of the cooking equipment's plume. This approach, while technically adequate from a plume capture and containment perspective, is far from being energy efficient. For example, an exhaust hood designed to handle the exhaust from grilling twenty steaks and an equivalent amount of potatoes in the deep fryer as side dishes for the steaks might be used when only a single egg is being cooked for a breakfast dish.

The need for more energy efficient kitchen ventilation systems that provide a safe and comfortable working environment have necessitated an entire rethinking of the over powering method. For example, U.S. Pat. No. 4,286,572 discloses a ventilating hood that includes an air supply assembly. The air supply assembly directs substantially all of the air incoming to the hood toward the exhaust filter of the hood, and a minor segment of the air flow substantially downwardly for creating an air shield above the frontal portion of a heating apparatus (e.g., a cooker). The incoming supply air is used to help urge the fumes toward the filter. However, in operation, such an exhaust hood may have less than ideal operating characteristics. For example, the flow rate of exhaust air required to capture and contain the heat and effluents from the cooking equipment may actually have to be increased to overcome the added short circuit air, the space that it occupies, and the turbulence that it creates, thus using more energy, not less, and hindering, not improving, the surrounding kitchen environment.

U.S. Pat. No. 4,811,724 discloses a ventilating hood that includes a blow chamber. The blow chamber directs a plurality blow jets to induce secondary air jets. The blow jets are utilized to assist in the capture and containment of the exhaust effluents. Although the design allows for the ability to adjust the total volume of air being supplied to the blow jets, it does not allow for the individual adjustment of the blow jets, thus the blow jets cannot be adjusted to meet varying characteristics of the plume in different sections of the hood. The lack of adjustability of the blow jets also may make it difficult to maintain a beneficial relationship between the flow rate of the supply air and the speed of the blow jets when making adjustments to the total supply air flow rate. Again, in operation, such a hood may fall short of achieving a significant reduction of exhaust flow rates, and of effectively and efficiently exhausting fumes.

Therefore, improved exhaust hoods that can effectively exhaust kitchen fumes are desirable, especially exhaust hoods that can exhaust kitchen fumes in an energy efficient manner.

BRIEF SUMMARY

Exhaust hoods and related methods for exhausting fumes are provided. In many embodiments, an exhaust hood includes a supply air assembly that directs a first portion of a flow of supply air across an exhaust collection area generally towards an exhaust inlet for the exhaust hood, and directs a second portion of the flow of supply air generally downward away from a collection region of the exhaust hood. The disclosed exhaust hoods and methods for exhausting fumes provide various beneficial features and/or characteristics. For example, the supply assembly can be adjustable to vary the portions of the supply air directed into the first and second portions. The flow rate of the first portion can be substantially equal to the flow rate of the second portion. The supply assembly can be adjustable to vary the portions of the supply air directed into the first and second portions along a length of the exhaust hood (e.g., a frontal length, a side length).

The disclosed exhaust hoods and methods for exhausting fumes may provide a number of benefits relative to known exhaust hoods and methods for exhausting fumes. For example, the disclosed exhaust hoods and methods for exhausting fumes may provide the ability to adequately capture fumes at a reduced exhaust flow rate, thereby reducing the energy requirement for tempering incoming make-up air. In many embodiments, lengthwise adjustability may provide for a further decrease in exhaust flow rate by providing the ability to tailor operational characteristics of an exhaust hood along the length of an equipment line (e.g., a cooking line having varying effluent characteristics).

Thus, in a first aspect, an exhaust hood is provided. The exhaust hood includes a housing forming a collection region having an entry portion and an upper portion disposed above the entry portion, an exhaust inlet coupled with the housing and configured to draw air from the entry and upper portions, and a supply assembly coupled with the housing and configured to output a flow of supply air. The supply assembly is configured to direct a first portion of the supply air across the collection region generally toward the exhaust inlet and direct a second portion of the supply air generally downward away from the collection region. The first portion of the supply air divides the collection region into the entry and upper portions. The supply assembly is adjustable to vary the portion of the supply air directed into at least one of the first portion or the second portion. In many embodiments, at least one of the first portion or the second portion includes a slot stream airflow.

In many embodiments, the supply assembly includes an adjustable deflector to vary the portion of the supply air directed into at least one of the first portion or the second portion. The adjustable deflector can include one or more constriction features configured to vary the flow volume and velocity of at least one of the first portion or the second portion. The adjustable deflector can include at least one fairing disposed adjacent an exit for at least one of the first portion or the second portion. The supply assembly can include a plurality of slots configured to discharge the supply air upstream of the adjustable deflector. The adjustable deflector can include an upper deflector surface configured to at least partially direct the first portion of the supply air, and can include a lower deflector surface configured to at least partially direct the second portion of the supply air. At least one of the upper deflector surface or the lower deflector surface can be adjustable to vary the portion of the supply air directed into at least one of the first portion or the second portion. A position of the upper deflector surface and/or a position of the lower deflector surface can be adjustable to vary the portions of the supply air directed into the first portion and/or the second portion. The supply assembly can further include a plurality of adjustable fasteners for adjusting the position of the upper deflector surface and/or the lower deflector surface.

The supply assembly can have a side length perpendicular to the frontal length. The supply assembly can be configured to direct a third portion and/or a fourth portion of the supply air from the side length. The third portion can be directed across the collection region. The fourth portion can be directed generally downward away from the collection region.

In many embodiments, the supply assembly is adjustable along a length of the supply assembly (e.g., a frontal length, a side length). For example, the supply assembly can further include a plurality of segments distributed along the frontal length. Each segment can be adjustable to vary the portion of the supply air directed into the first portion and/or the second portion for the segment. The supply assembly can include a plurality of segments distributed along the side length. Each side segment can be adjustable to vary the portion of the supply air directed into at least one of the third portion or the fourth portion for the segment. The supply assembly can further include a plurality of variable speed supply air fans. Each variable speed supply air fan can provide supply air for one of the segments.

In another aspect, a method for exhausting fumes is provided. The method for exhausting fumes includes directing a first portion of a flow of supply air across a collection region generally toward an exhaust inlet so as to divide the collection region into an entry portion and an upper portion disposed above the entry portion, directing a second portion of the flow of supply air generally downward away from the collection region, drawing air from the entry portion of the collection region through the exhaust inlet, drawing air from the upper portion of the collection region through the exhaust inlet, and adjusting the portion of the flow of supply air directed into at least one of the first portion or the second portion. In many embodiments, the step of adjusting the portion includes adjusting a position of at least one of a first deflector surface or a second deflector surface to vary the portion of the supply air directed into at least one of the first portion or the second portion.

In many embodiments, the method for exhausting fumes includes additional steps. For example, the method can further include varying the flow rate of at least one of the first portion or the second portion along a length of the housing (e.g., a frontal length, a side length).

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

DETAILED DESCRIPTION

Exhaust hoods and related methods for exhausting fumes are provided. In many embodiments, an exhaust hood is configured for mounting above a fume source (e.g., cooking equipment) and utilizes a flow of supply air to direct first and second containment air streams so as to minimize the exhaust flow rate required to effectively capture and exhaust the fumes. The first containment air stream is directed across a collection region of the exhaust hood toward an exhaust inlet. The first containment air stream divides the collection region into an entry portion disposed at the bottom of the collection region and an upper portion disposed above the entry portion. The second containment air stream is directed generally downward away from a collection region of the exhaust hood. The exhaust inlet is configured to draw exhaust air from the entry and upper portions of the collection region. The supply assembly can be adjustable to vary the portions of the supply air directed into the first and second portions along a length of the exhaust hood (e.g., a frontal length, a side length).

Such an exhaust hood can be configured in various ways. For example, the supply assembly can include a supply chamber with two individual sectionalized adjustable low volume high velocity air slots (also referred to herein as containment air streams) that are strategically located within the hood to facilitate effective capture and containment of a cooking equipment plume at a lower exhaust flow rate (e.g., cubic feet per minute (CFM)) than prior exhaust hoods.

When cooking equipment is used, varying amount of heat and effluents are typically produced that form an unsteady thermal plume rising up from the cooking equipment. An exhaust hood is typically located above the cooking equipment to capture and exhaust the effluents. As the effluents enter a collection region of the exhaust hood, the amount of the plume that is exhausted is largely determined by the design of the exhaust hood and the flow rate (e.g., CFM) of air that is exhausted.

When a high exhaust flow rate (e.g., CFM) is used, the majority of the effluents may be directly exhausted on a first pass by an exhaust inlet of the exhaust hood. However, as the flow rate exhausted from the hood is reduced in an effort to reduce energy consumption, a lesser amount of the plume may be exhausted from the hood on the first pass by the exhaust inlet, and the design of the hood becomes more important for the total capture and containment of the plume.

Exhaust hoods in accordance with the described embodiments of the present invention incorporate a diverter and two supply air containment air streams that work to facilitate effective capture and containment of cooking effluents at advantageously lower exhaust flow rates than prior exhaust hood designs.

Figure 1:
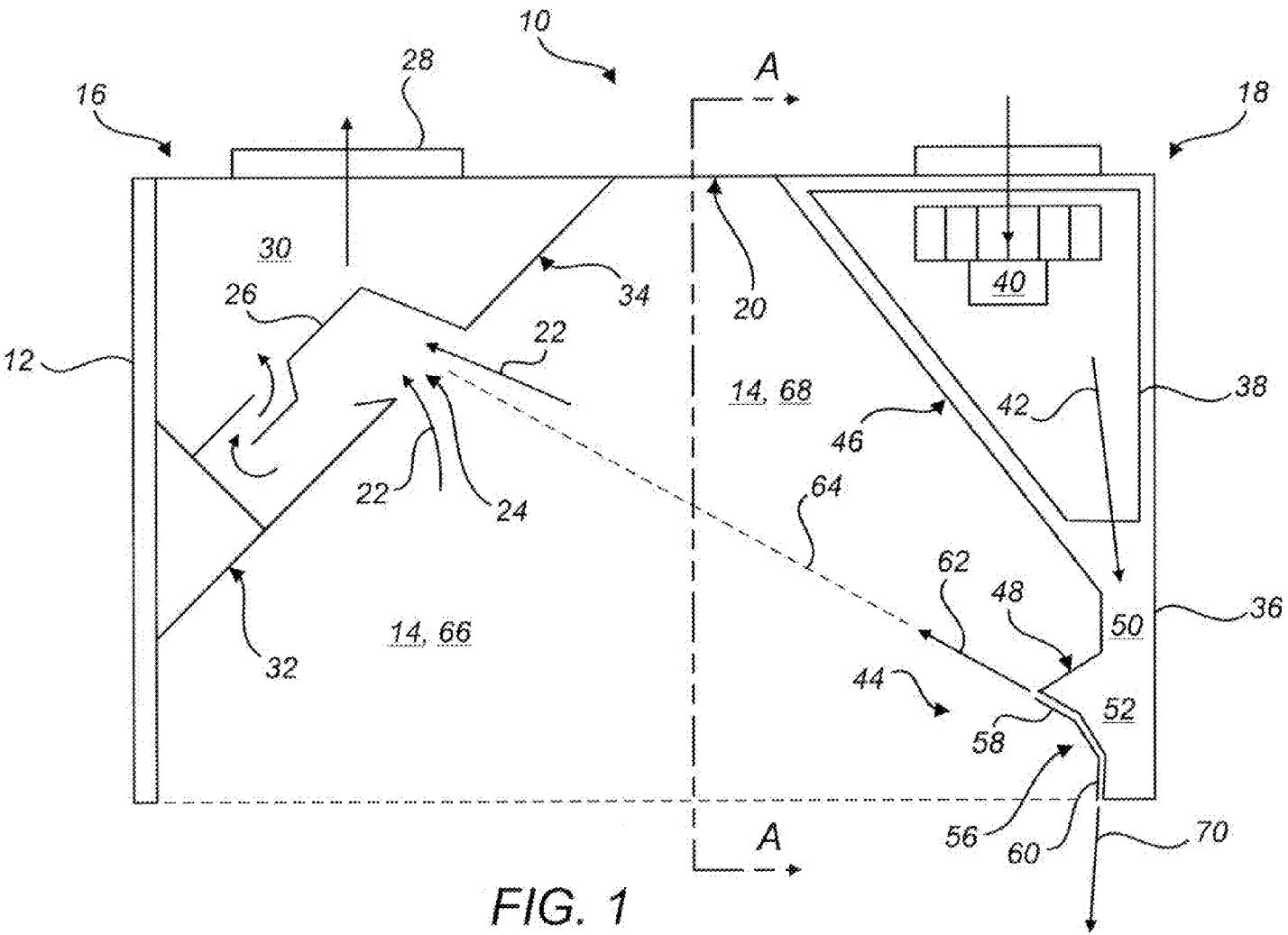
FIG. 1 is a simplified partial side view of an exhaust hood in accordance with an embodiment of the present invention.

FIG. 1 shows a simplified partial side view of the exhaust hood 10 in accordance with an embodiment of the present invention. The exhaust hood 10 includes a housing 12 that defines a hood recess or collection region 14. The collection region 14 can be formed by a combination of the housing 12 and adjacent walls (e.g., a back wall and/or a side wall(s)). The collection region 14 is located between an exhaust assembly 16 and a supply assembly 18. The collection region 14 is further bounded by a top hood surface 20.

The exhaust assembly 16 draws exhaust air 22 from the collection region 14 through an exhaust inlet 24 into an exhaust filter 26 via the action of an exhaust duct 28 and an exhaust fan (not shown). The exhaust filter 26 captures particulate and/or grease before the exhaust air 22 enters an exhaust chamber 30. In many embodiments, the exhaust filter 26 subjects the exhaust air 22 to a tortuous path. Details of an example exhaust filter that can be used are described in U.S. Pat. No. 6,394,083, the full disclosure of which is hereby incorporated herein by reference. Other known filter arrangements, for example baffles filters, can also be used. In many embodiments, the exhaust fan is a variable speed exhaust fan for selectively varying the flow rate of the exhaust air 22. The exhaust assembly 16 further includes a hack lower diverter surface 32 and a back upper diverter surface 34.

Figure 3:
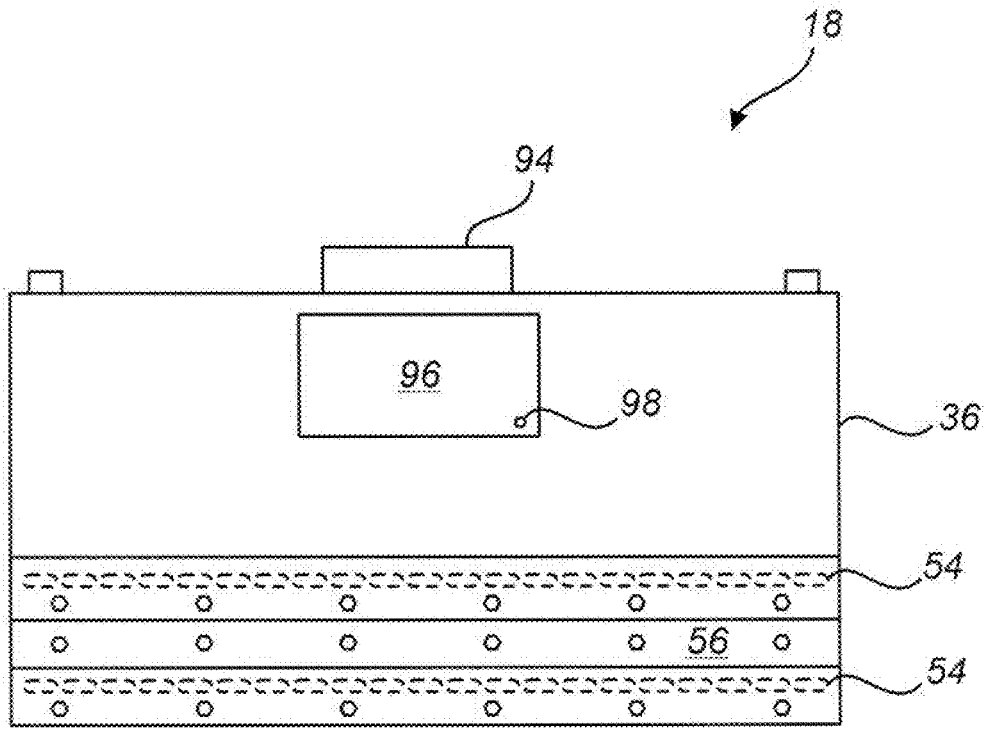
FIG. 3 illustrates sectional view A-A of FIG. 1.

The supply assembly 18 includes a supply chamber 36, a fan plenum 38 disposed in the supply chamber 36, a supply fan 40 motivating a supply airflow 42, an outlet assembly 44 coupled with the supply chamber 36 to direct supply airflow discharged from the supply chamber 36, a front upper diverter surface 46, and a front lower diverter surface 48. Supply airflow 42 from the fan plenum 38 is directed toward a narrowed passage 50 in the supply chamber 36. Airflow from the narrowed passage 50 continues toward an expanded flow region 52 of the supply chamber 36. The expanded flow region 52 forms another plenum. From the expanded flow region 52, the supply airflow discharges through a plurality of slots 54 (shown in FIG. 3). The expanded flow region 52 is disposed upstream of the slots 54 and ensures a uniform flow distribution through the slots 54. As can be seen in FIG. 3, the slots 54 are arranged in an upper set and a lower set. Air exiting the two sets of slots 54 impinges upon a baffle plate 56 disposed downstream of the slots 54. The baffle plate 56 includes an upper containment airstream baffle 58 and a lower containment airstream baffle 60. In many embodiments, the baffle plate 56 is adjustable to vary the portions of the supply airflow 42 directed in two directions from the supply assembly 18. The baffle plate 56, in cooperation with the adjacent surfaces of the supply chamber 36, directs the supply airflow discharged from the slots 54 along two slot airstreams. A first portion of the supply airflow 42 forms a first airstream 62 that is directed along a projected path 64 generally toward the exhaust inlet 24. As shown in FIG. 1, a projected path 64 of the first airstream 62 divides the collection region 14 into an entry portion 66 disposed below the projected path 64 and an upper portion 68 disposed above the projected path 64. A second portion of the supply airflow 42 forms a second airstream 70 that is directed generally downward away from the collection region 14 (e.g., toward a cooking line).

Figure 2A:
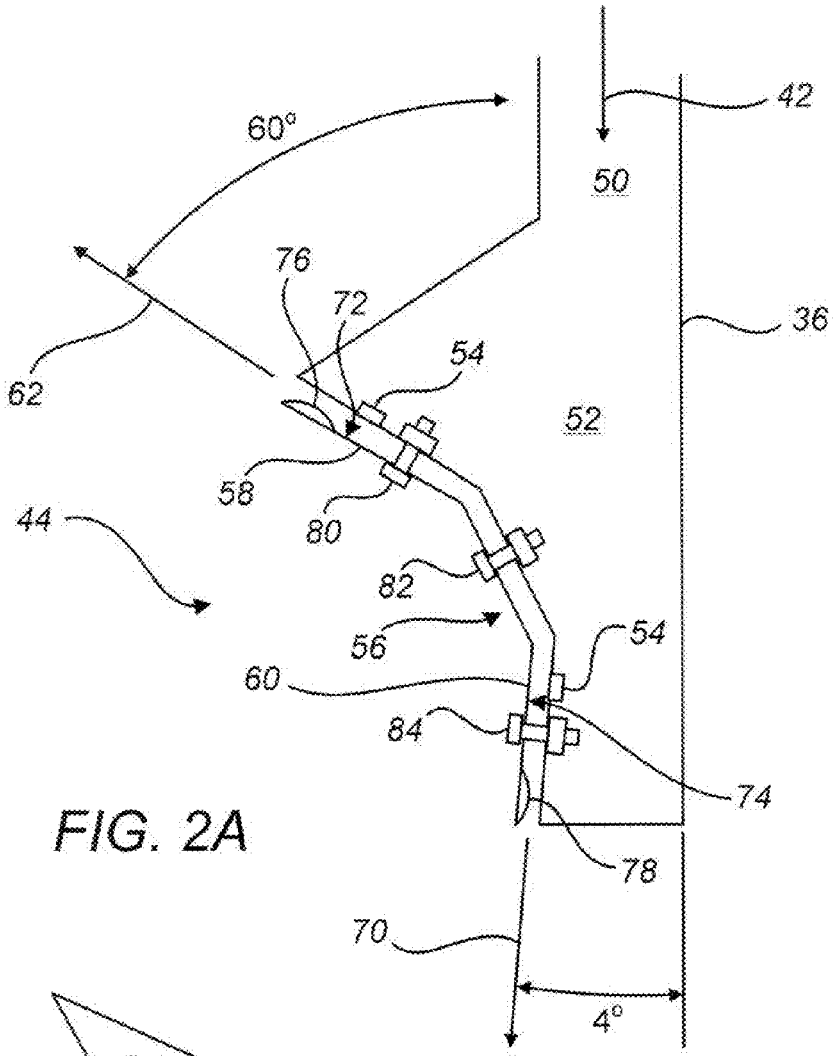
FIG. 2A illustrates a supply air outlet assembly for the exhaust hood of FIG. 1.
Figure 2B:
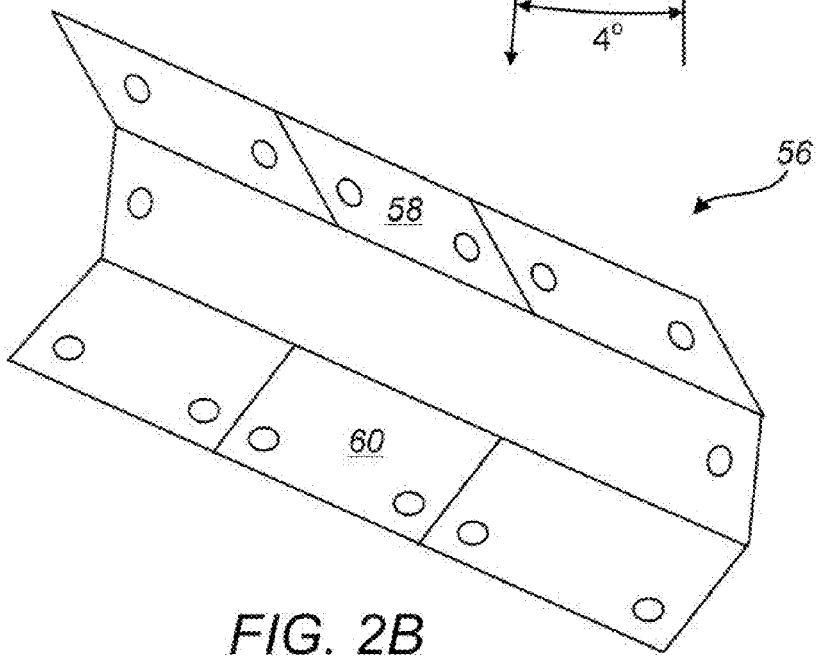
FIG. 2B is a perspective view of a containment airstream baffle plate of the outlet assembly of FIG. 2A.

FIGS. 2A and 2B illustrate the outlet assembly 44 and the containment air stream baffle plate 56 of the outlet assembly 44. The outlet assembly 44 comprises the baffle plate 56 and a plurality of fasteners coupling the baffle plate 56 with the supply chamber 36. The baffle plate 56 includes the upper containment air stream baffle 58 having an upper deflector surface 72, and the lower containment air stream baffle 60 having a lower deflector surface 74. The baffle plate 56 can include an upper constriction feature 76 configured to increase the flow velocity of the first air stream 62, and can have a lower constriction feature 78 configured to increase the flow velocity of the second air stream 70. The baffle plate 56 can be formed from sheet metal. The baffle plate 56, which can have any length, can be connected with the supply chamber 36 using at least three sets of fasteners including, for example, an upper fastener 80, a middle fastener 82, and a lower fastener 84. The middle fastener 82 can be used to secure the baffle plate 56 with the supply chamber 36, for example, such that the baffle plate 56 is held separated from the supply chamber 36 by a fixed distance along the middle fastener set. The upper fastener 80, which can be an adjustable fastener, can be used to adjust the distance between the upper baffle 58 and the adjacent surface of the supply chamber 36. Likewise, the lower fastener 84, which can be an adjustable fastener, can be used to adjust the distance between the lower baffle 60 and the adjacent surface of the supply chamber 36. The outlet assembly 44 is configured to cause the two containment airstreams 62, 70 to issue from the supply assembly 18 in the illustrated directions. In the embodiment illustrated, the outlet assembly 44 is configured to cause the upper containment air stream 62 to issue with an angle of approximately 60 degrees with respect to the up (vertical) direction so that the upper containment air stream 62 crosses the containment region 14 with an upwardly direction (i.e., at 30 degrees with respect to horizontal), which may help to effectively guide fumes in both the entry portion 66 and the upper portion 68 of the collection region 14 toward the exhaust inlet 24. Furthermore, the outlet assembly 44 (shown in FIG. 2A) is configured to cause the lower containment air stream 70 to issue with an angle of approximately 4 degrees with respect to the vertical direction. The 4 degree direction of the lower containment air stream 70 provides a slight angle to the resulting air curtain so as to urge air flow toward the exhaust hood without impinging directly on the cooking surface. However, the 60 degree direction angle for the upper containment air stream 62 and the 4 degree direction for the lower containment airstream 70 are merely exemplary, and the supply assembly 18 can be designed to cause the air streams to issue at other appropriate angles. The separation between the baffle plate 56 and the adjacent surfaces of the supply chamber 36 can be adjustable, and the separation, in many embodiments, is less than 0.25 inches. For certain applications, the baffle plate 56 can be set to entirely close the separation between the baffle plate 56 and the adjacent surfaces of the supply chamber 36 and thus not supply any containment air stream. In one preferred arrangement, the baffle plate 56 is set so that the containment air stream 62, 70 have substantially equal flow rates.

Figure 2C:
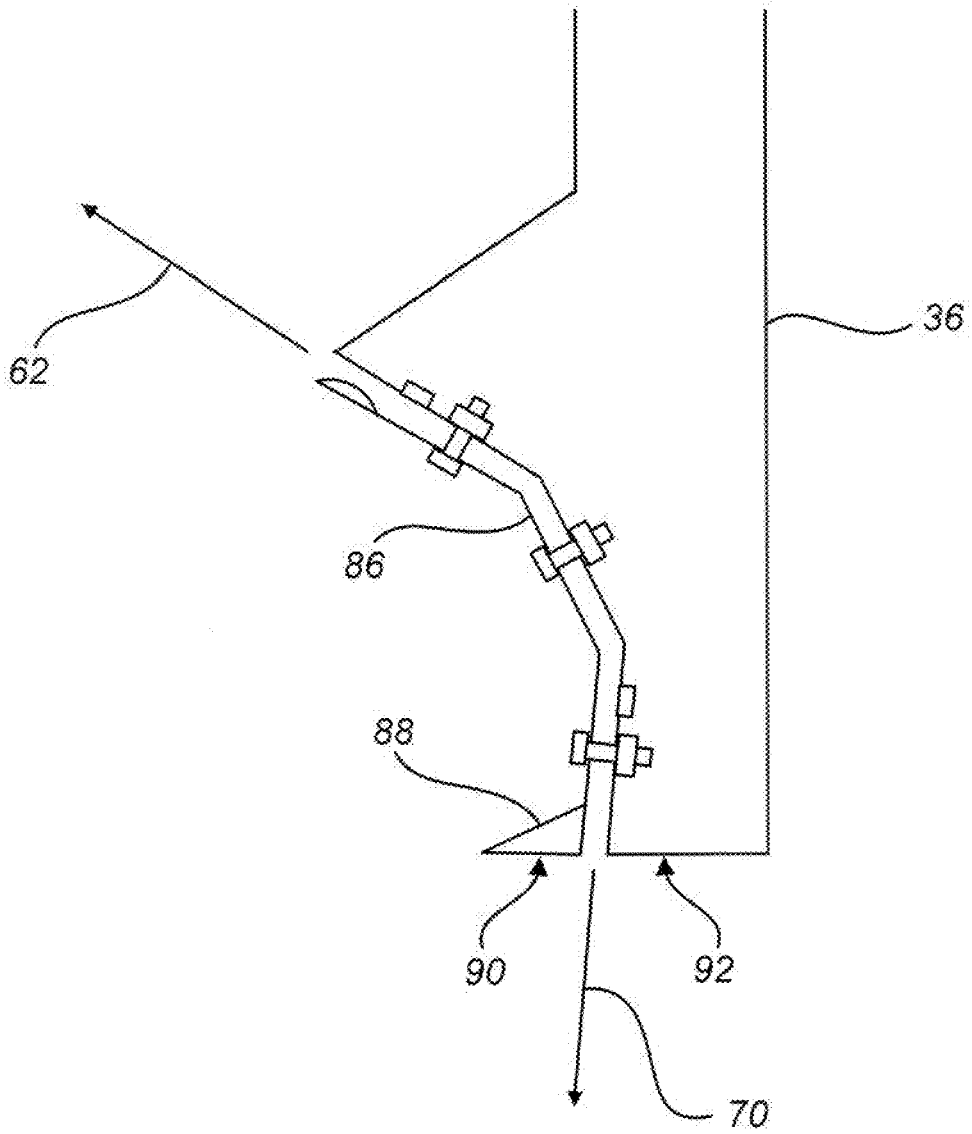
FIG. 2C illustrates a containment airstream baffle plate in accordance with an embodiment.

FIG. 2C illustrates a baffle plate 86 in accordance with an embodiment. The baffle plate 86 includes a lower fairing 88 configured to provide an improved exit geometry for the second air stream 70. The lower fairing 88 provides a surface 90 adjacent to the exit for the second air stream 70 that is similar to the opposing adjacent surface 92 on the supply chamber 36. Such similar opposing surfaces may provide for a more balanced and/or stable interaction between the second air stream 70 and the surrounding air, which may produce a more stable second air stream 70. The baffle plate 86 can also include a similar upper fairing (not shown) disposed adjacent the exit for the first air stream 62.

FIG. 3 shows sectional view A-A of FIG. 1, which illustrates details of the supply assembly 18. Supply air enters the supply assembly 18 through a supply collar 94. In many embodiments, the supply collar 94 is coupled with a fire damper. A removable access panel 96 provides access to the supply air fan. The supply air fan can be a variable speed fan, and the removable access panel 96 can include a speed control access provision 98 for a variable speed controller for the supply air fan. The two sets of slots 54 provide a discharge path for the supply airflow from the expanded flow region of the supply chamber 36. Additional slots, additional rows, and/or other discharge path geometries can be employed to discharge supply airflow from the supply chamber 36. The baffle plate 56, in cooperation with adjacent surfaces of the supply chamber 36, direct the supply airflow issuing from the slots 54 into the containment air streams described above. The configuration of the supply assembly 18 is exemplary in nature, and other supply assembly configurations can be used to produce the above described containment air streams.

Figure 4:
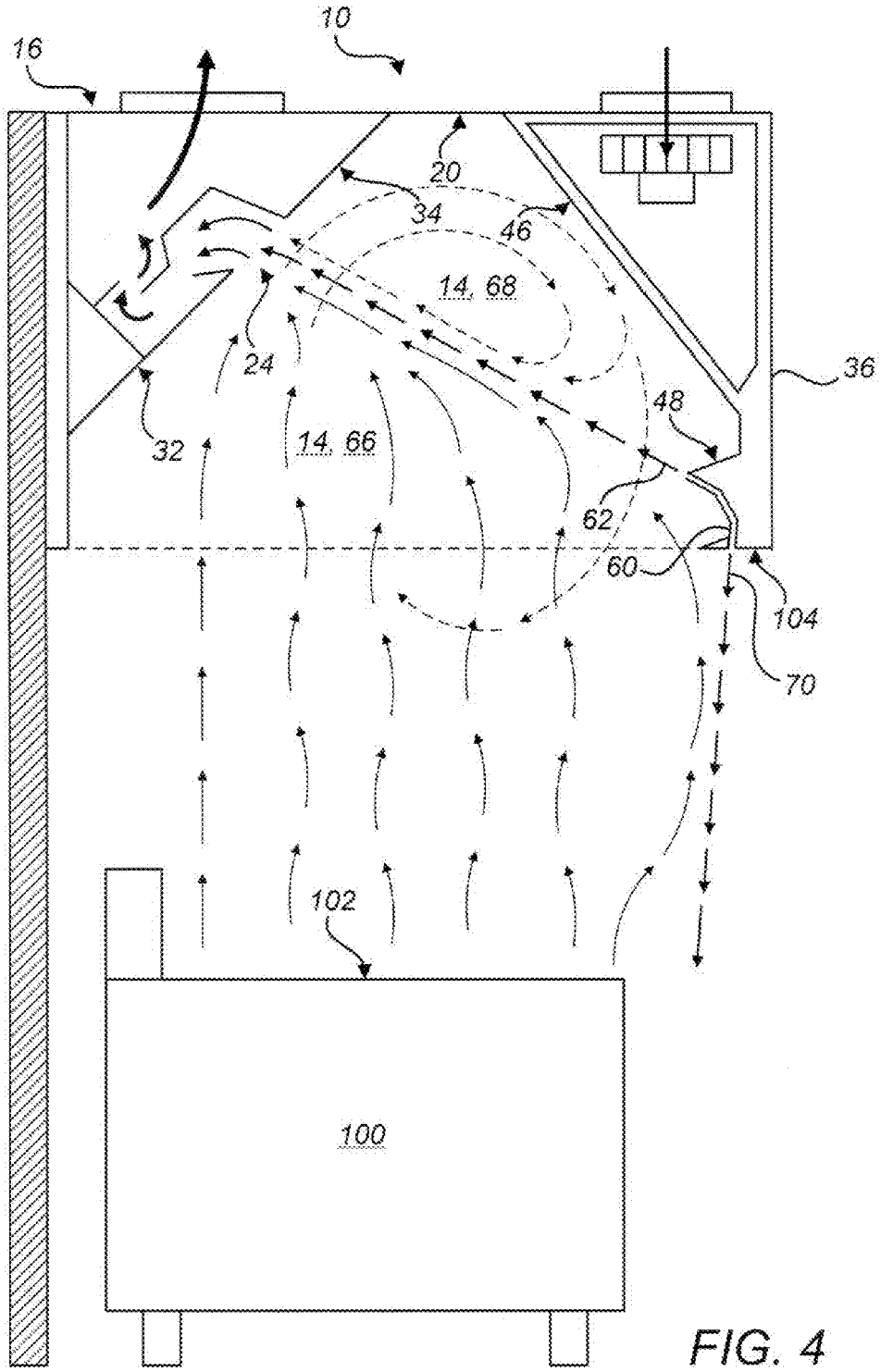
FIG. 4 is a simplified side view of the exhaust hood of FIG. 1, illustrating example air flows during the operation of the hood.

FIG. 4 shows a simplified side view of the exhaust hood 10 of FIG. 1, illustrating example air flows during the operation of the exhaust hood. The lower containment air stream 70 helps to ensure that the cooking plume is properly directed toward the collection region 14 of the exhaust hood 10. The lower air stream 70 creates a negative pressure that draws adjacent fresh air from the surrounding area towards the hood and keeps effluents under the exhaust hood collection region 14. This may be especially beneficial when pulsations in the plume cause the plume to expand in an outward-upward direction as well as the more prevalent upward direction. A plume pulsation that is expanding outward-upward from the cooking equipment 100 towards the front of the exhaust hood 10 is advantageously affected by the lower containment air stream 70.

As can be seen in FIG. 4, the lower containment air stream 70 exits the spacing between the supply chamber 36 and the lower containment air stream baffle 60 in a downward and slightly inward direction. In this manner, the lower containment airstream 60 creates a low-volume high-velocity air curtain that may stop pulsations in the plume from continuing in an outward-upward direction past the front perimeter of the exhaust hood 10, and also may influence the plume to travel in a more upward direction into the collection region 14. The lower containment air stream 70 is directed at such an angle that it does not influence the cooking surface 102 of the cooking equipment 100.

In operation, as the plume enters the entry portion 66 of the collection region 14, the plume is influenced by the back lower diverter surface 32 of the exhaust assembly 16. The back lower diverter surface 32 directs the rear portion of the plume in an upward-forward direction towards the exhaust inlet 24. The plume rises into the top of the entry portion 66 of the collection region 14 where it is influenced by the upper containment air stream 62. As the plume travels up the back lower diverter surface 32 toward the exhaust inlet 24, the upper containment air stream 62, working in the same manner as the lower containment airstream 70, continues the work started by the lower containment airstream 70 by hindering the forward expansion of the rising thermal plume and pushing the plume back towards the back lower diverter surface 32 and the exhaust inlet 24.

A significant portion of the exhaust plume may be exhausted during its initial pass by the exhaust inlet 24. However, due to varying characteristics of the plume and low exhaust flow rates achievable using the exhaust hood 10, not all of the plume may be exhausted on the its first pass by the exhaust inlet 24.

The portion of the plume not exhausted on its first pass by the exhaust inlet 24 may continue past the exhaust inlet 24 into the upper portion 68 of the collection region 14 where it begins to circulate and be influenced by the back upper diverter surface 34, the top surface 20 of the exhaust hood 10, the front upper diverter surface 46, the front lower diverter surface 48, and the upper containment air stream 62. The upper containment air stream 62 can meet the plume heading in a downward direction and can redirect the plume to an upward-inward direction back towards the exhaust inlet 24 where the plume is then exhausted or repeats the circulating pattern within the upper portion 68.

Any portion of the plume traveling in a outward direction from the cooking equipment 100 towards the front or the side of the hood may come into influence of the lower containment air stream 70. The plume moving in an outward direction maybe contained by the lower containment air stream 70 from escaping from under the hood and redirected towards the back of the hood, where it may become entrained with the rising plume and redirected up into the collection region 14.

The lower containment air stream 70 may create a beneficial lower pressure area relative to the pressure of the surrounding room on a front inner edge 104 of the exhaust hood 10 as a result of the lower containment air stream's low-volume high-velocity air movement. This area of lower pressure may create a vacuum effect along the front inner edge 104 that draws air into the exhaust hood 10 from the surrounding higher-pressure area outside of the exhaust hood 10, and thereby help in the capture and containment of the plume.

In many embodiments, an exhaust hood can have a plurality of adjustable baffles arranged along the length of the supply chamber of the exhaust hood. Each of the adjustable baffles can be set for a different or same arrangement of the containment air streams. The air streams can be divided into individual smaller segments along the entire length of the exhaust hood and each segment can be made to be individually adjustable. The ability to adjust each airstream in individual segments may provide for a reduction in the exhaust flow rate that the exhaust hood requires to obtain effective capture and containment of fumes.

Figure 5:
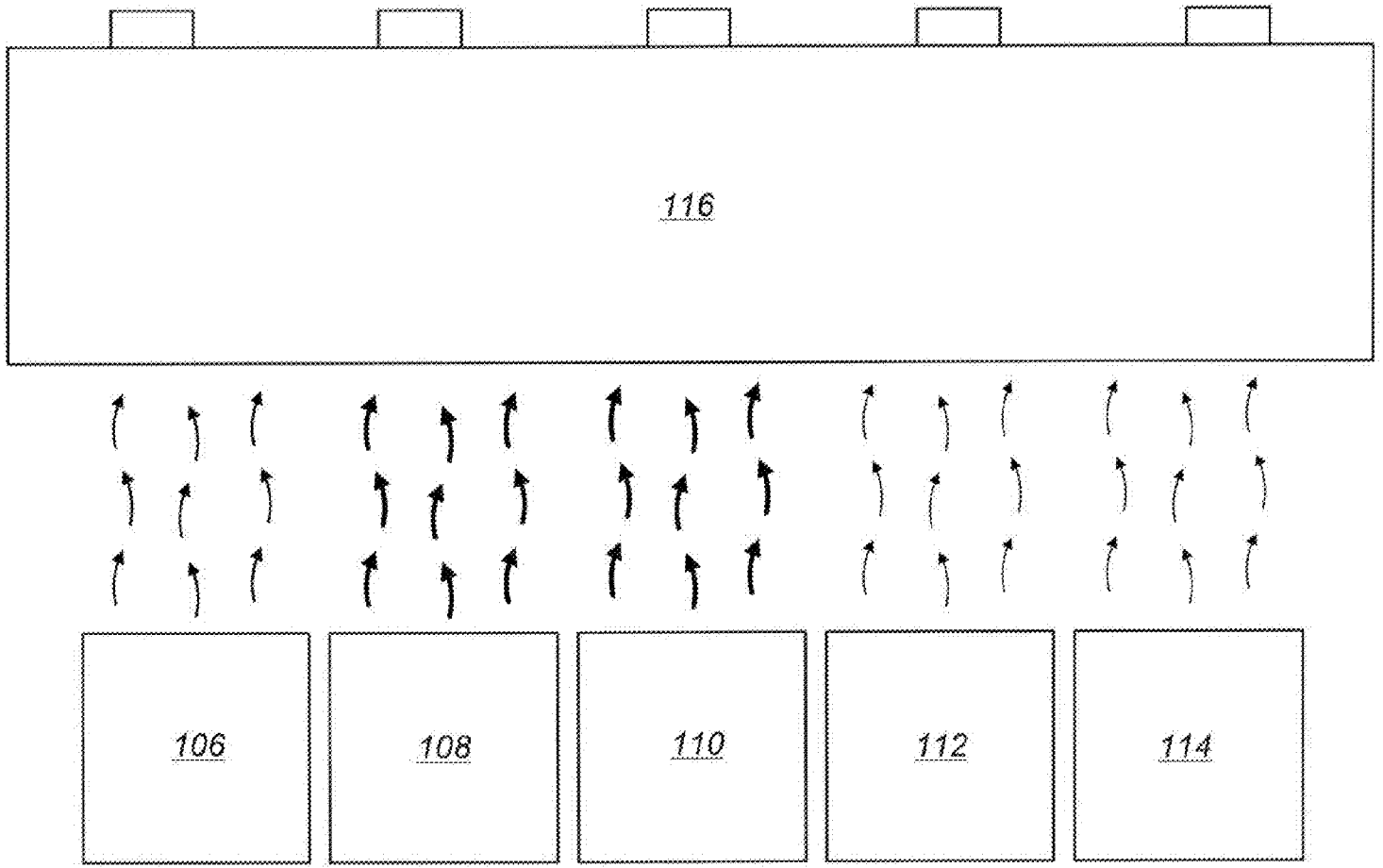
FIG. 5 is a simplified front view of a cook line having an exhaust hood in accordance with many embodiments.

As illustrated in FIG. 5, a thermal plume created by cooking equipment 106, 108, 110, 112, 114 may have varying characteristics due to different cooking equipment, techniques, fuels and cooking levels being used. In many embodiments, the containment air streams are adjustable to accommodate these varying characteristics so that cooking fumes may be captured and contained at lower exhaust flow rates than with existing exhaust hoods. The varying plumes created by the different cooking equipment, techniques, fuels, and loads may occupy varying amounts of space, form different varying plume patterns, and/or travel at varying velocities within an exhaust hood 116. Some plumes may originate more towards the back of the exhaust hood where others may originate more towards the front, some plumes may be hotter (e.g., as depicted by the darker plume lines rising from the cooking equipment 108, 110) and others cooler (e.g., as depicted by the lighter plume lines rising from the cooking equipment 112, 114), some plumes may have more pulsing than other plumes, and some plumes may have heavier cooking effluents, all of which may contribute to varying characteristics of the plume.

Therefore, the ability to individually adjust and control supply airflow volume and velocity of the containment air streams for each segment of the exhaust hood along the length of the exhaust hood can be used to set up the exhaust hood in a configuration to effectively control, capture, contain, and exhaust varying plumes. Such a tailored configuration may provide for reduced exhaust flow rates relative to existing exhaust hoods.

The exhaust hood can be fitted with a supply air fan(s) that provides the airflow(s) for the containment air streams. The supply air fan(s) can be equipped with a variable speed controller(s) that allows for the precise adjustment of the volume of the supply airflow(s).

In many embodiments, the containment air streams capture and contain cooking fumes using a low flow rate of supply airflow that is squeezed between the supply chamber and the baffle plate. By squeezing a low volume of air between the baffle plate and the supply chamber, a high air speed can be obtained. The containment air streams can be directed in precise directions that may have been predetermined to effectively capture, contain and exhaust the plume.

The use of a high air speed and a low flow rate of supply airflow in the lower containment air stream may have the positive effect of redirecting the outer boundary of the plume in the desired direction. However, the upper containment air stream may quickly dissipate as it becomes entrained with the major body of the plume and thus may not create unwanted turbulence in the major portion of the plume rising up and into the back of the exhaust hood.

It should be noted that it may be beneficial to configure the containment air streams such that they introduce a small amount of air into the collection region, since every amount of air that is introduced by the upper containment air stream into the hood collection region occupies valuable space in the collection region and becomes additional air that will have to be exhausted from the collection region. A properly designed kitchen ventilation system requires an equal amount of make-up air to be supplied to replace the exhausted air. Therefore, as the flow rate of exhaust air is reduced, the corresponding flow rate of make-up air is also reduced, respectively. Studies have shown that make-up air for a kitchen is not only very costly to provide due to the necessity of having to temper the make-up air, but it can also be very discomforting to the kitchen environment and be a major contributing cause to a poorly functioning exhaust hood due to cross currents caused by the introduction of makeup air. Thus, the reduction of flow rate of exhaust air provided by the exhaust hoods describe herein may reduce the amount of make-up air that is required, thus further improving the functionality of the exhaust hood and the environment of the kitchen, and may also reduce the amount of noise that the kitchen ventilation system generates while significantly adding to lower energy usage of a kitchen ventilation system.

Figure 6:
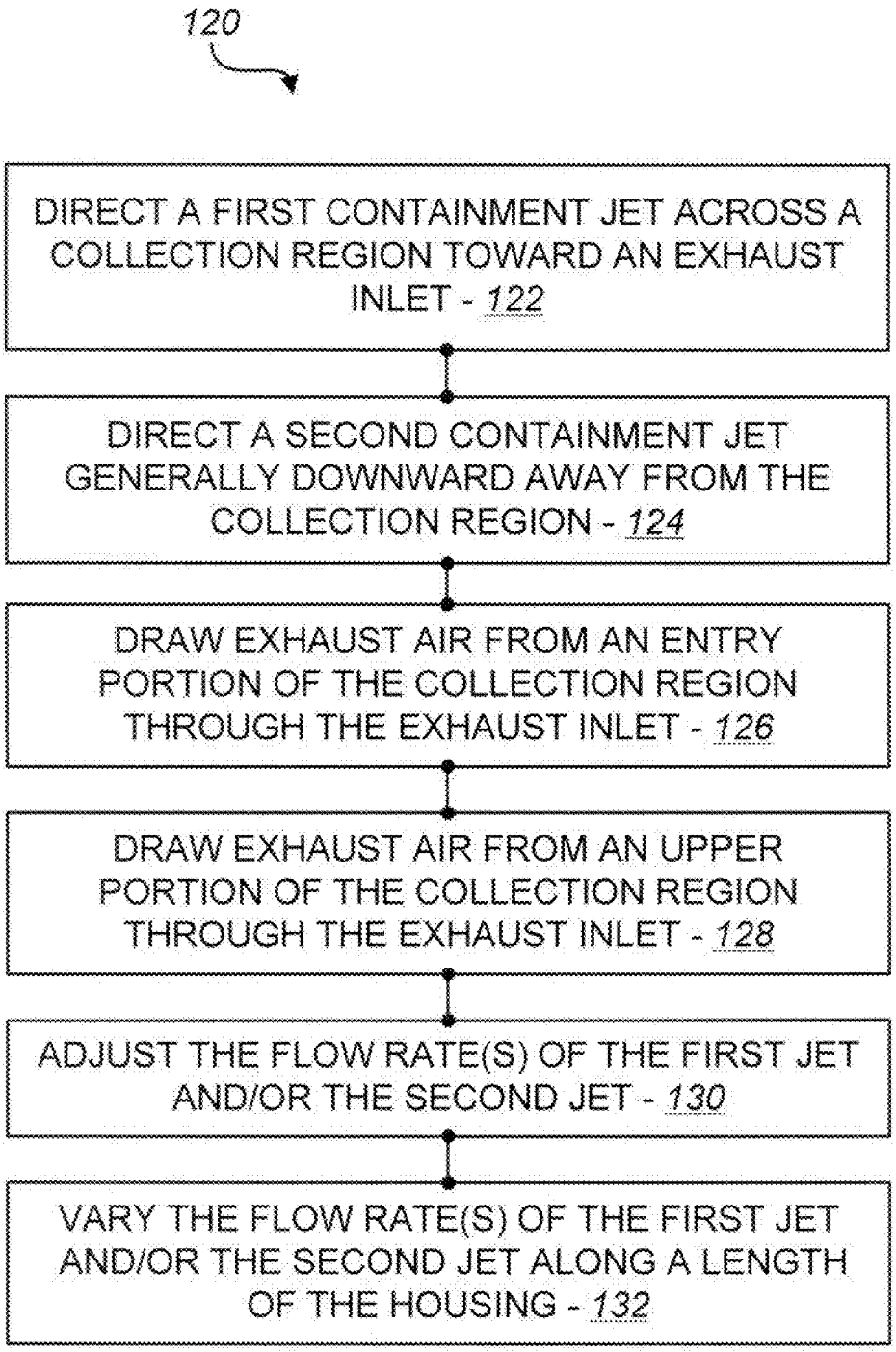
FIG. 6 is a block diagram of a method for exhausting fumes, in accordance with many embodiments.

FIG. 6 shows a block diagram of a method 120 for exhausting fumes, in accordance with many embodiments. The above described exhaust hoods can be configured for use in practicing the method 120. In step 122, a first containment air stream is directed across a collection area generally toward an exhaust inlet so as to divide the collection region into an entry portion and an upper portion disposed above the entry portion. In many embodiments, the first portion is directed as a slot stream of air. In step 124, a second containment air stream is directed generally downward away from the collection region. In many embodiments, the second portion is directed as a slot stream of air. In step 126, exhaust air is drawn from the entry portion of the collection region through the exhaust inlet. In step 128, exhaust air is drawn from the upper portion of the collection region through the exhaust inlet. In step 130, the flow rate(s) of the first portion and/or the second portions are adjusted. In many embodiments, a position of a deflector surface is adjusted to vary the portion of the supply air directed into at least one of the first portion or the second portion. In step 132, the flow rate and/or direction of the first and second portions of the supply air are varied along a length of the housing (e.g., a frontal length, a side length).

Experimental Results

The table below demonstrates the remarkable advantages that are gained with a presently disclosed exhaust hood. These results were obtained with containment air streams flowing at approximately 10 cfm/ft per airstream and at a flow velocity of approximately 500 fpm.

TABLE 1

| Hood Type | Cooking Temp | Exhaust Rate |
|---|---|---|
| Containment Airstream Hood | 600 F. | 180 cfm/ft |
| Without Containment Airstreams | 600 F. | 250 cfm/ft |
| Containment Airstream Hood | 400 F. | 120 cfm/ft |
| Without Containment Airstreams | 400 F. | 150 cfm/ft |

Table 1 summarizes the results of tests. These results show reduced exhaust rates achieved using an exhaust hood as described above. Such reduced exhaust rates reduce the energy consumption required to sustain the continuing operation of an exhaust hood.

While the containment air streams were described to issue from the supply plenum where the air streams are directed to issue primarily from the front of the hood, an exhaust hood can also be configured to issue air streams from the lateral ends of the hood.

As will be understood by those skilled in the art, the present invention may be embodied in other specific forms without departing from the essential characteristics thereof. For example, the supply chamber exit may use any combination of slots or differently-shaped apertures to direct supply air onto the baffle. Many other embodiments are possible without deviating from the spirit and scope of the invention. These other embodiments are intended to be included within the scope of the present invention, which is set forth in the following claims.

What is claimed is:

1. An exhaust hood, comprising:

a housing comprising an air inlet chamber and a main chamber, wherein the air inlet chamber and the main chamber are connected by a passage, wherein the main chamber defines a collection region comprising an entry portion and an upper portion disposed above the entry portion, wherein the entry portion and the upper portion are in spatially continuous, unimpeded fluid communication with one another;

an exhaust inlet coupled with the housing and configured to draw air directly from both the entry portion and the upper portion; and a supply assembly disposed in the passage, and configured to output a flow of supply air from the air inlet chamber, the supply assembly configured to direct a first portion of the supply air from the air inlet chamber into the main chamber across the collection region generally towards the exhaust inlet, and direct a second portion of the supply air from the air inlet chamber generally downward away from the collection region, the supply assembly configured to direct the first portion substantially along a straight line to thereby define an air stream, wherein the air stream divides the collection region into the entry and upper portions, the supply assembly adjustable to vary the portion of the supply air directed into at least one of the first portion or the second portion;

the supply assembly further being configured to direct the first portion of the supply air such that, when exhaust is present in the upper portion, the exhaust circulates within the upper portion, and the air stream redirects the circulating exhaust within the upper portion towards the exhaust inlet.

2. The exhaust hood of claim 1, wherein at least one of the first portion or the second portion comprises a slot airstream airflow.

3. The exhaust hood of claim 1, wherein the supply assembly comprises an adjustable deflector to vary the portion of the supply air directed into at least one of the first portion or the second portion.

4. The exhaust hood of claim 3, wherein the adjustable deflector comprises one or more constriction features configured to increase the flow velocity of at least one of the first portion or the second portion.

5. The exhaust hood of claim 3, wherein the adjustable deflector comprises at least one fairing disposed adjacent an exit for at least one of the first portion or the second portion.

6. The exhaust hood of claim 3, wherein the supply assembly further comprises a plurality of slots configured to discharge the supply air upstream of the adjustable deflector.

7. The exhaust hood of claim 3, wherein the adjustable deflector comprises:

an upper deflector surface configured to at least partially direct the first portion of the supply air; and a lower deflector surface configured to at least partially direct the second portion of the supply air.

8. The exhaust hood of claim 7, wherein at least one of the upper deflector surface or the lower deflector surface is adjustable to vary the portion of the supply air directed into at least one of the first portion or the second portion.

9. The exhaust hood of claim 8, wherein a position of the upper deflector surface and a position of the lower deflector surface are adjustable to vary the portions of the supply air directed into the first and second portions.

10. The exhaust hood of claim 9, wherein the supply assembly further comprises a plurality of adjustable fasteners for adjusting the position of the upper and lower deflector surfaces.

11. The exhaust hood of claim 1, wherein the supply assembly has a frontal length, the supply assembly further comprising a plurality of segments distributed along the frontal length, each segment adjustable to vary the portion of the supply air directed into at least one of the first portion or the second portion for the segment.

12. The exhaust hood of claim 11, wherein the supply assembly has a side length perpendicular to the frontal length, the supply assembly further configured to direct a third portion of the supply air from the side length and direct a fourth portion of the supply air from the side length, the third portion directed across the collection region and the fourth portion directed generally downward away from the collection region.

13. The exhaust hood of claim 12, wherein the supply assembly further comprises a plurality of segments distributed along the side length, each segment adjustable to vary the portion of the supply air directed into at least one of the third portion or the fourth portion for the segment.

14. The exhaust hood of claim 11, wherein the supply assembly further comprises a plurality of variable speed supply air fans, each variable speed supply air fan providing supply air for one of the segments.

15. The exhaust hood of claim 1, wherein the supply assembly comprises a variable speed supply air fan.

16. The exhaust hood of claim 1, wherein the supply assembly is adjustable so that the first and second portions have substantially equivalent flow rates.

17. The exhaust hood of claim 1, wherein the supply assembly is adjustable to vary at least one of the direction of the first portion or the direction of the second portion.

18. A method for exhausting fumes, the method comprising:

supplying a flow of supply air into an air inlet chamber of a hood;

providing a first portion of the flow of supply air from the air inlet chamber, through a passage, into a main chamber of the hood;

directing the first portion of the flow of supply air substantially along a straight line across a collection region of the main chamber generally toward an exhaust inlet to thereby define an air stream along the straight line;

with the air stream, dividing the collection region into an entry portion and an upper portion disposed above the entry portion, wherein the entry portion and the upper portion are in spatially continuous, unimpeded fluid communication with one another;

when exhaust is present in the upper portion:

circulating the exhaust within the upper portion; and with the air stream, redirecting the circulating exhaust within the upper portion towards the exhaust inlet;

providing a second portion of the flow of supply air from the air inlet chamber, through the passage;

directing the second portion of the flow of supply air generally downward away from the collection region;

drawing air from the entry portion of the collection region directly through the exhaust inlet;

drawing air from the upper portion of the collection region directly through the exhaust inlet; and adjusting the portion of the flow of supply air directed into at least one of the first portion or the second portion.

19. The method of claim 18, wherein the adjusting the portion step comprises adjusting a position of at least one of a first deflector surface or a second deflector surface to vary the portion of the supply air directed into at least one of the first portion or the second portion.

20. The method of claim 18, further comprising varying the flow rate of at least one of the first portion or the second portion along a length of the housing.

* * * * *